United States Patent [19]

Smith

[11] 4,311,238

[45] Jan. 19, 1982

[54] CLOSURE AND A PACKAGE EMPLOYING THE CLOSURE

[75] Inventor: Ernest L. Smith, Kansas City, Mo.

[73] Assignee: Phillips Petroleum Company, Bartlesville, Okla.

[21] Appl. No.: 107,794

[22] Filed: Dec. 27, 1979

[51] Int. Cl.[3] ..... B65D 21/02; B65D 41/18

[52] U.S. Cl. ..... 206/508; 220/306

[58] Field of Search ..... 206/508, 509; 220/306, 220/307, 352

[56] References Cited

U.S. PATENT DOCUMENTS

| | | | |
|---|---|---|---|
| 2,978,142 | 4/1961 | Novick . | |
| 3,065,875 | 11/1962 | Negoro . | |
| 3,516,572 | 6/1970 | Davis | 220/306 |
| 3,743,133 | 7/1973 | Rathbun | 220/306 |
| 4,051,951 | 10/1977 | Smith | 220/352 |

*Primary Examiner*—George E. Lowrance

[57] ABSTRACT

A closure has a plurality of generally U-shaped stacking lugs. A package utilizing the closure has a bottom rim with a conformation which effectively mates with the stacking lugs to provide a stackable package.

27 Claims, 6 Drawing Figures

CLOSURE AND A PACKAGE EMPLOYING THE CLOSURE

The invention relates to a closure. In one aspect, the invention relates to a stackable package. In another aspect, the invention relates to a package. In another aspect, the invention relates to a cylindrical container in combination with a thermoformed closure, which thermoformed closure is provided with means for receiving, centering, and preventing lateral movement of the bottom of a superimposed container of like configuration. In another aspect, the invention relates to a thermoformed closure for such a container having a top outside rolled rim or bead, the closure being provided with a plurality of means for gripping the container rim or bead.

In the manufacture of a package employing a container and a closure wherein each is made from a relatively flexible material, difficulties can be encountered in maintaining mating dimensions. This is particularly true where the container is formed of, for example, fibrous material such as paperboard, and the closure is thermoformed from a sheet of synthetic organic thermoplastic material, for example, polyethylene or polystyrene. The variations in dimensions make it difficult to consistently achieve a satisfactory seal of the packaging cavity and to provide a package which can be readily opened when desired but which has a high resistance to inadvertent opening and is resealable.

Further, the thermoplastic closure and the thermoplastic coating frequently employed on the outer surface of the container have minimal frictional characteristics, often rendering it difficult to maintain stable stacks of such containers. Stacking of such containers, however, is a desirable method of storing and displaying large quantities of such containers.

Accordingly, an object of the present invention is a new and improved package. Another object of the invention is a package having stable stacking characteristics even with stacking surfaces formed of thermoplastic material having low frictional resistance properties. Another object of the invention is a closure having means for gripping the outside rolled top rim or bead of a corresponding container. Another object of the invention is a thermoformed closure sealingly engaging a container having an outside rolled top rim or bead. Other objects, aspects, and advantages of the invention will be apparent from a study of the specification, the drawings, and the claims appended hereto.

BRIEF DESCRIPTION OF THE INVENTION

As used herein, when a first structure or element is said to be "circumferentially continuous" with a second structure or element, the phrase is used to indicate that the first structure or element is continuous with the second structure along at least a portion of the circumference or periphery of the second structure or element, and not necessarily along the entire circumference or periphery of the second structure or element.

In accordance with one aspect of the invention, the invention comprises a closure comprising a central diaphragm. The central diaphragm is circumferentially continuous with a first slanting wall which extends generally outwardly and upwardly from the diaphragm. The first slanting wall is circumferentially continuous along an upper portion thereof with an annular wall which extends generally upwardly. The annular wall is circumferentially continuous along an upper portion thereof with a generally upwardly concavely curved annular rim wall which extends generally outwardly and upwardly. The annular rim wall is circumferentially continuous along an outer portion thereof with a top rim wall which extends generally outwardly. The top rim wall is circumferentially continuous along an outer portion thereof with a generally downwardly extending skirt wall. The first slanting wall and the annular wall are interrupted by a plurality of projections. Each projection has an upper surface segment concavely continuous with a respective portion of the generally concavely curved annular rim wall forming a generally concavely curved shelf.

In accordance with another aspect of the invention, the invention comprises a package having such a closure and further comprising a container. The container has a circumferentially continuous sidewall and a bottom member. The bottom member is situated within a space defined by the sidewall adjacent a lower end of the sidewall. The upper end of the sidewall is curved generally outwardly and downwardly to form a generally outwardly rolled top rim. The lower end of the sidewall is curved generally inwardly and upwardly in conjunction with the bottom member to form a generally convexly inwardly rolled bottom rim.

The package in accordance with this invention provides a uniquely stable stackable package for shipment and display of packagable material. The stacked packages are especially stable against disarrangement by lateral forces.

Figure 1:
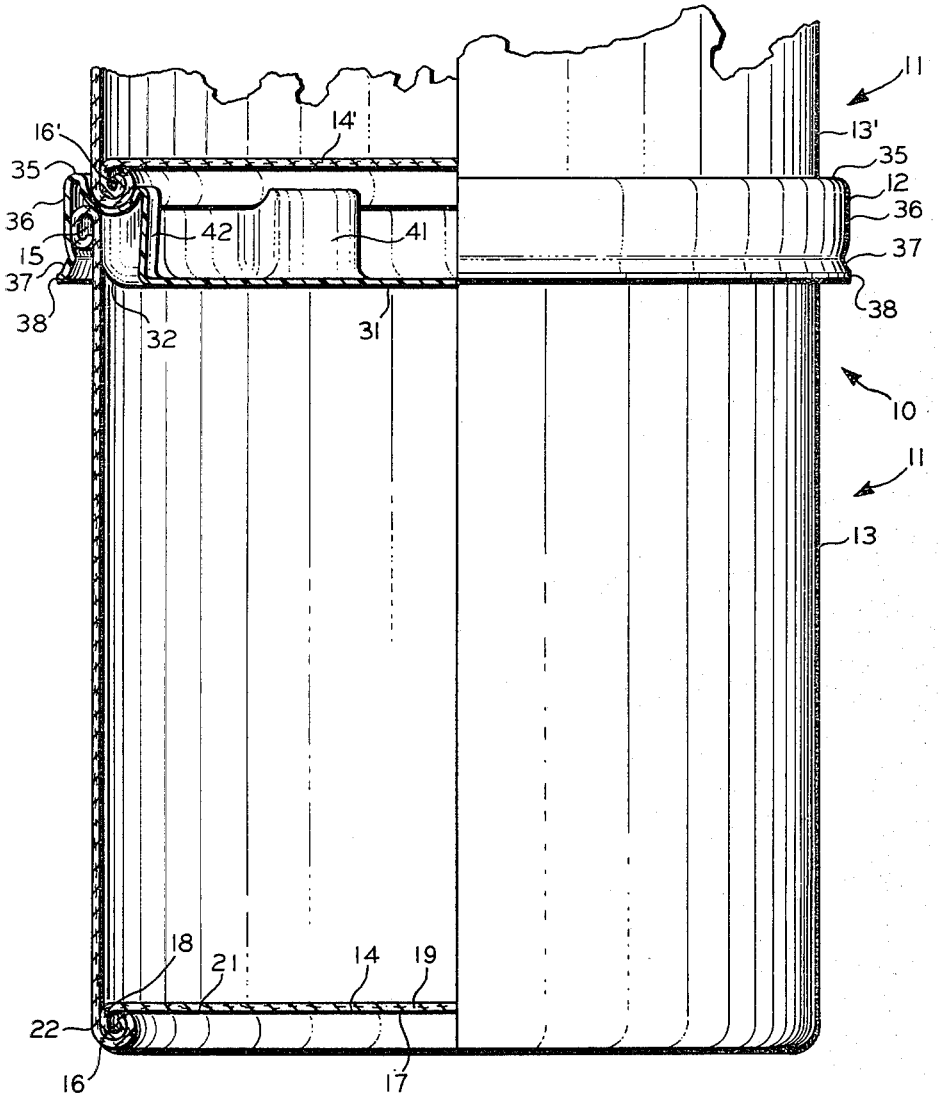
FIG. 1 is a side elevational view, having a portion cut away to reveal structure, of a package embodying the present invention, the package having a substantially similar container superimposed thereon.

Referring now to the drawings in detail and in particular to FIG. 1, reference numeral 10 designates generally a package comprising a container or cup 11 and a closure 12. Reference numeral 11' designates a superimposed container of the same general type as container 11. The container 11 has a circumferentially continuous sidewall 13 and a bottom member 14. The bottom member 14 is situated within the space defined by the sidewall 13 and adjacent the lower end of sidewall 13. Apart from the rolled upper rim 15 and the rolled bottom rim 16, the sidewall 13 has a generally cylindrical configuration. The bottom member 14 has a circular diaphragm 17 and an annular skirt 18 depending from the periphery of diaphragm 17. The central portion 19 of diaphragm 17 is substantially planar with the marginal portion 21 of diaphragm 17. The outer surface of skirt 18 is bonded to the inner surface of sidewall 13. The annular portion 22 of sidewall 13 which extends downwardly beyond the lower extent of skirt 18 has been curled inwardly and upwardly to form a generally convexly curved bottom rim 16 which extends inwardly from the cylindrical portion of sidewall 13 and can be used to support in part diaphragm 17. The upper margin of sidewall 13 has been curled outwardly and downwardly to form the convexly curved upper rim 15 which extends outwardly from the cylindrical portion of sidewall 13.

Figure 2:
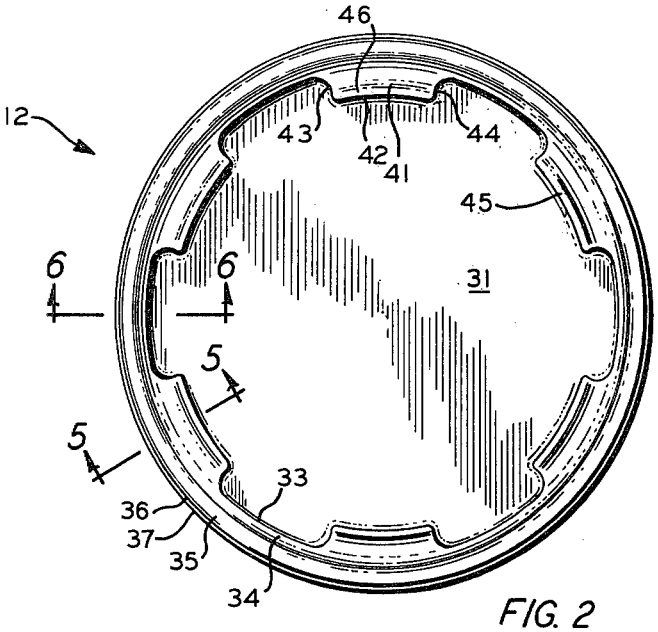
FIG. 2 is a top plan view of a closure in accordance with this invention.
Figure 3:
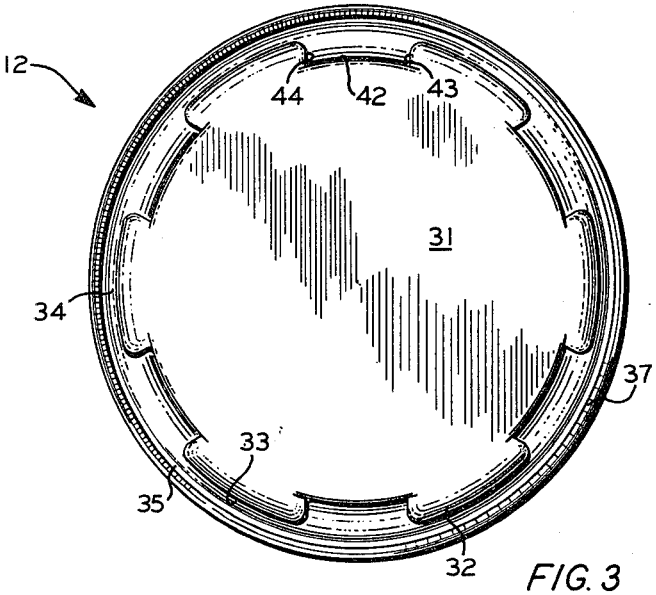
FIG. 3 is a bottom view of the closure of FIG. 2.
Figure 4:
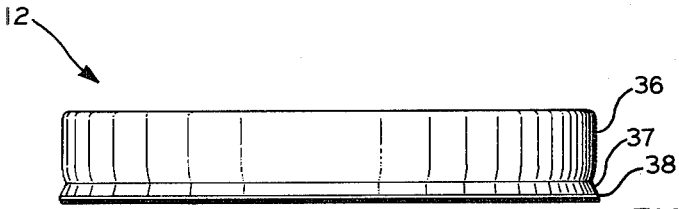
FIG. 4 is a side elevational view of the closure of FIG. 2.
Figure 5:
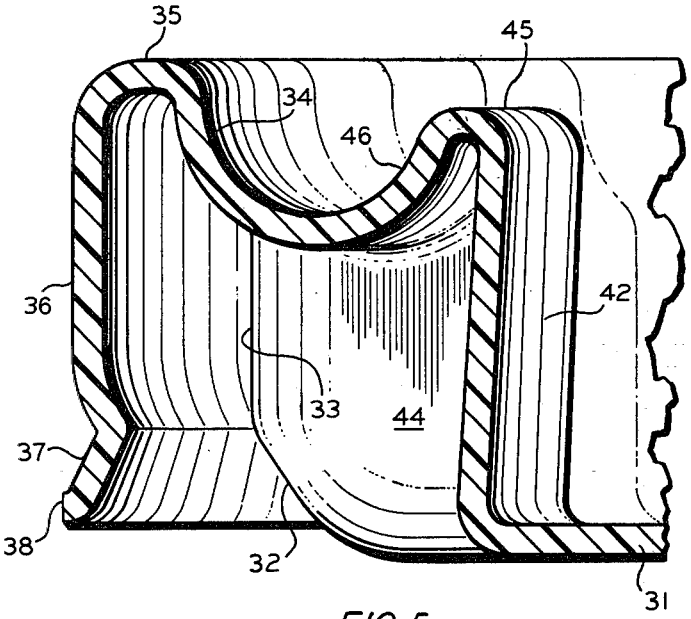
FIG. 5 is a sectional view taken along the line 5—5 of FIG. 2 showing the cross sectional structure of a stacking lug in accordance with the present invention.
Figure 6:
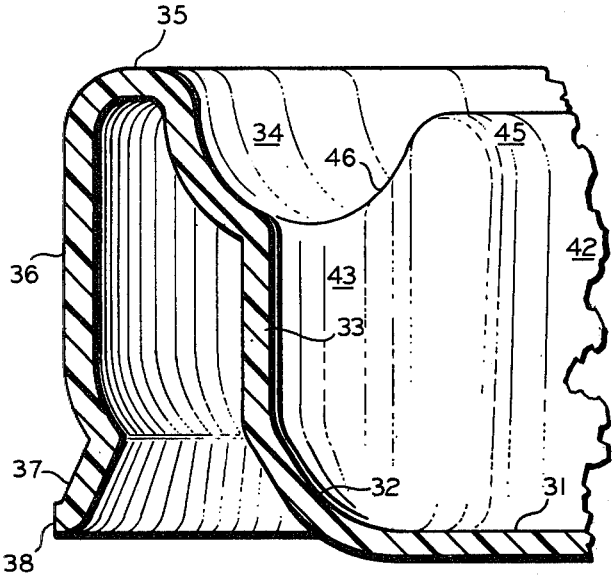
FIG. 6 is a sectional view taken along the line 6—6 of FIG. 2, showing the cross sectional structure of the closure at a point lacking a stacking lug.

The closure 12 is a one-piece structure which can be formed from any suitable material. For example, the closure can be thermoformed from a synthetic organic thermoplastic material, for example, polyethylene or polystyrene. The closure can have a substantially circular horizontal cross section. The illustrated closure as best shown in FIGS. 5 and 6 comprises generally a central diaphragm 31, a first slanting wall 32, an annular wall 33, an annular rim wall 34, a top rim wall 35, a skirt wall 36, a second slanting wall 37, and a ledge 38. The first slanting wall 32 and the annular wall 33 are interrupted by a plurality of projections or support lugs 41 shown most clearly in FIGS. 2, 3 and 4. Each of the support lugs comprises an inner wall 42, respective sidewalls 43 and 44, a shoulder 45, and an upper surface segment 46.

As indicated the closure comprises a closure disk or diaphragm 31 which in the illustrated embodiment is generally circular in shape. Diaphragm 31 has a diameter smaller than the inner diameter of the cylindrical portion of sidewall 13. In the illustrated embodiment, the diaphragm 31 is generally planar and lies in a plane slightly below that of the plane of ledge 38, corresponding to the lower portion of second slanting wall 37.

The first slanting wall 32 is generally circumferentially continuous with the outer periphery of diaphragm 31 and extends generally outwardly and upwardly therefrom to form an outward facing generally convexly shaped slanting surface to facilitate insertion of the closure 12 into the container 11. As shown best in FIGS. 5 and 6, the upper extent of first slanting wall 32 and the upper extent of second slanting wall 37 are approximately coplanar.

Annular wall 33 extends at least generally vertically from the upper portion of first slanting wall 32 in at least general conformity to the contour of the contiguous portion of the cylindrical sidewall 13 of container 11 adjacent and below the commencement of the rolled top rim when the closure 12 is applied to the container 11. In a preferred embodiment of the package, the annular wall 33 of the closure at least generally conforms to the contour of the portion of the container sidewall 13 adjacent to and below the commencement of the rolled top rim 15, the annular wall 33 having a maximum outside diameter, before the application of the closure 12 onto its respective container 11, which is at least as great as the minimum corresponding diameter of the inside surface of the portion of the container sidewall 13 contacted by the annular wall 34 when the closure 12 is applied to a respective container 11. This can provide a frictional engagement between the annular wall 33 of the closure 12 and the top inside portion of the container sidewall 13.

An upwardly opening, generally concavely curved annular rim wall 34 extends outwardly and upwardly from the upper extent of annular wall 33 to the inner extent of circumferentially continuous top rim wall 35. The thus formed upwardly opening generally concave surface provides a positioning means for engaging at least an outer portion of the curved bottom rim 16' of a superimposed container 11' of generally identical shape to container 11. At least a lower portion of the thus formed concave surface of annular rim wall 34 substantially conforms to at least an outer portion of the downwardly directed generally convexly curved surface of bottom rim 16'. The thus formed concave surface of annular rim wall 34 can, for example, have at least a lower portion thereof which is circularly concave. Preferably the inner diameter of each portion of annular rim wall 34 is only slightly larger than the corresponding outer diameter of a respective portion of rolled bottom rim 16'. The correspondence in configuration between annular rim wall 34 and rolled bottom rim 16' of the superimposed container 11' enables the rim 16' to enter the space defined by the concavely curved annular rim wall 34 and to thereby cause the superimposed container 11' to be positioned coaxially with closure 12 and container 11. Preferably, at least an upper portion of annular rim wall 34 can be generally cylindrical and can extend generally parallel to the generally cylindrical sidewall of superimposed container 11' and thereby assist in preventing lateral movement of a thus coaxially aligned superimposed container 11'. To achieve this end, annular rim wall 34 can have a height sufficient to surround at least a portion of the generally cylindrical sidewall 13' adjacent bottom roll 16' of a coaxially aligned, superimposed container 11'.

Top rim wall 35 extends generally outwardly from and circumferentially continuous with an upper portion of annular rim wall 34. The inner diameter of top rim wall 35 is at least slightly larger than the maximum outside diameter of bottom rim 16' of superimposed container 11'. The top rim wall 35 can extend generally horizontally outwardly from annular rim wall 34 to a diameter approximately equal to the maximum outside diameter of rolled top rim 15. Top rim wall 35 can, for example, be planar or generally convexly or downwardly curved.

A circumferentially continuous skirt wall 36 extends generally downwardly from the outer extent of top rim wall 35. Skirt wall 36 can extend generally vertically downwardly from the outer extent of top rim wall 35 to at least the point at which the top rolled rim 15 of sidewall 13 commences to curve inwardly toward the container sidewall 13. Skirt wall 36 can then continue inwardly and downwardly, curving in general conformity to at least a portion of the curvature of the adjacent inwardly curving portion of rim 15. Preferably, the length of the skirt wall 36 is at least as great as the vertical diameter of rolled top rim 15; for example, the length of the skirt wall 36 can be in the range of 1 to 3 times the vertical diameter of the rolled top rim 15. More preferably, the length can be in the range of about $1\frac{1}{4}$ to about $2\frac{1}{2}$ times the vertical diameter of rolled top rim 15.

A circumferentially continuous second slanting wall 37 extends generally outwardly and downwardly from the lower extent of skirt wall 36 and is terminated by a generally horizontally outwardly directed flange or ledge 38.

The horizontal distance between the uppermost extent of first slanting wall 32 and second slanting wall 37 is preferably less than the horizontal thickness of top rolled rim 15. When a closure 12 is applied to a container 11, the rolled rim 15 enters the beveled space between first slanting wall 32 and second slanting wall 37 and is coaxially positioned relative to the closure. Continued application of force wedges the skirt 36 outwardly and permits the rolled top rim 15 to enter the space defined by skirt wall 36, top rim wall 35, annular rim wall 34, and annular wall 33. When the rim 15 penetrates this space beyond the commencement of second slanting wall 37, the resiliency of the closure composition causes the skirt wall 36 to close on the rim 15 forming a seal therebetween. Another seal can be formed between the inwardly and downwardly curving surface of rim 15 and a corresponding portion of annular rim wall 34. When the closure 12 is in position on the container 11, the ridge formed by the line of confluence between skirt wall 36 and second slanting wall 37 acts as a locking ridge to maintain the closure in place on the container. Frictional engagement between respective portions of skirt wall 36 and annular wall 33 with the top rim 15 of the container can also assist in maintaining the closure in position.

In order to increase the support surface for bottom rim 16' of a properly aligned superimposed container 11' and to assure proper alignment of a superimposed container 11' so that the bottom rim 16' does not enter the depression formed by wall 33, the walls 32 and 33 are interrupted by a plurality of projections or support lugs 41. The support lugs 41 extend inwardly toward the central vertical axis of closure 12. Each lug has an inner wall 42 and respective sidewalls 43 and 44, each of which extends generally vertically upwardly from diaphragm 31 to a shoulder 45. Shoulder 45 is attached to annular rim 34 by wall surface segment 46. The configuration of the upwardly opening, generally concavely curved surface segment 46 substantially conforms to the upwardly directed generally convexly contoured inner portion of bottom rim 16'. The corrrespondence in configuration between segment 46 and rim 16' enables a portion of the bottom rim 16' of a superimposed container 11' to enter the space defined between annular rim 34 and segment 46 and to thereby cause the superimposed container 11' to be positioned coaxially with closure 12 and container 11.

Thus, in a preferred embodiment, at least two features significantly contribute to stability of the stacked package. First, the configuration of the annular rim wall 34 at least generally conforms to at least an outer portion of the rolled bottom 16 to provide a means for engaging the corresponding portion of the curved bottom rim 16' of an at least substantially identical container 11' superimposed thereabove. Second, the configuration of the concave upper surface segment 46 of each of the plurality of projections 41 at least generally conforms to at least an inner portion of the rolled bottom rim 16' to provide means for engaging the corresponding portion of the rolled bottom rim 16' of an at least substantially identical container 11' superimposed thereabove. As the rolled bottom rim 16' of a superimposed container 11' enters the space defined between respective portions of the annular rim wall 34 and the respective upper surface segments 46, the superimposed container 11' is caused to be positioned on the shelf thereby defined coaxially with the closure 12.

Inner wall 42 of projection 46 is generally concentric with wall 33. Inner wall 42 can be vertical or can be inclined slightly from the vertical, for example, inner wall 42 can be inclined or slant inwardly from its base to the shoulder 45 at an angle in the range of about 0 to 6 degrees from the vertical, more preferably 2 to 4 so that the angle subtended between diaphragm 31 and inner wall 42 is in the range of 84 to 90 degrees, preferably 86 to 88 degrees, in order to reduce the tendency of closures to stick together when stacked together and oriented such that stacking lugs 41 of each closure are aligned and intermeshed. In the illustrated embodiment, inner wall 42 is slightly inclined from the vertical as best seen in FIG. 1 and FIG. 5.

Shoulder 45 is, in a preferred embodiment, a generally outwardly concave wall portion connecting inner wall 42 and segment 46. However, any suitable configuration can be employed. Segment 46 and a corresponding portion of annular rim 34 form a generally U-shaped space therebetween. Preferably the space thus formed is generally continuously concavely curved so that the diameter of each portion of the vertically extending part of annular rim wall 34 is only slightly larger than the diameter of the corresponding outer portion of rim 16' and so that the diameter of each portion of the vertically extending part of segment 46 is only slightly smaller than the corresponding inner portion of rim 16'. The correspondence in configuration that the space defined by ring 34 and segment 46 bears to rim 16' enables the bottom 16' of a superimposed container 11' to enter the thus defined space. The conformation of the space and the superimposed rim 16' insures that the superimposed container 11' will be positioned coaxially with closure 12 and container 11. The outer diameter of shoulder 45 can be approximately equal to the minimum inner diameter of rim 16 with the concavely upward curvature of a respective segment 46 at least substantially conforming to the convexly downward curvature of the inner portion of bottom rim 16'.

The stability of a superimposed container will depend, inter alia, upon the conformation of the space defined between rim 34 and segment 46 and the conformation of the rim 16'. Preferably at least a lower portion of the space thus defined is generally circularly concave and at least the lower portion of rim 16 is generally convex.

The stability of a superimposed container is also influenced by the extent to which the U-shaped space 34 surrounds rim 16'. It is preferred that surface segment 46 extend upwardly from its lowest point to provide stability to a superimposed container. Stacking stability can be enhanced when at least a lower portion of the surface segment 46 is circularly concave having an arc between about zero and 90°, more preferably between 70° and 90°. Stacking stability can also be enhanced when at least an upper portion of surface segment 46 is generally cylindrical. As shown the height of shoulder 45 can be slightly less than the height of annular rim wall 34 to facilitate accommodation of the bottom member 14' of superimposed container 11'.

In a presently preferred embodiment there are at least six lugs or projections 41 which are preferably uniformly equidistantly spaced about the periphery of diaphragm 31 although two long lugs (each lug being approximately ¼ the circumference of the top rim wall) or any suitable number of shorter lugs approximately equally spaced can be used. The lugs 41 also give greater rigidity to the closure structure. In the illustrated embodiment, each of first slanting wall 32 and annular wall 33 is circumferentially annularly continuous except for the presence of the support lugs or projections 41, and support lugs 41 do not interfere with the camming action of first slaning wall 32 or the frictional engagement of annular wall 33 with the corresponding surface of sidewall 13. Annular rim wall 34 can extend downwardly, as indicated above, from top rim wall 35 into sealing contact with the inside upper portion of rolled rim 15 to thereby form a seal for the packaging cavity. Circumferentially continuous seals can also be formed between a respective portion of skirt wall 36 and the contiguous portion of the outer and/or lower portion of rolled rim 15. The illustrated closure structure is particularly advantageous in providing a circumferentially continuous seal regardless of the normally encountered variations in the dimensions of rolled rim 15. The downward and inward inclination of first slanting wall 32 and the downward and outward inclination of second slanting wall 37 not only aid in camming the slightly larger diametered annular wall 33 into the mouth of container 11, but also aid in camming the rolled rim 15 into the space between wall 33 and skirt wall section 36.

While the invention has been illustrated in terms of a presently preferred embodiment, other configurations can be employed in accordance with the invention. The container 11 can have a frustoconical configuration with an angle of taper of several degrees instead of a cylindrical configuration. The container and the closure can be other configrations, for example, oval, generally rectangular, or polygonal with rounded angles so as to have a circumferentially continuous sidewall 13. Where the seal is provided between rolled rim 15 and annular rim wall 34, the closure top rim wall 35 and the skirt wall section 36 can be plain or provided with fluting as desired. The configuration of annular rim wall 34 can differ from that of curved bottom rim 16' so long as ring 34 can receive and position the bottom rim 16'. Other reasonable variations and modifications are possible within the scope of the foregoing disclosure, the drawings and the appended claims to the invention.

That which is claimed is:

1. A closure comprising:

a central diaphragm;

a first slanting wall circumferentially continuous with the central diaphragm and extending outwardly and upwardly therefrom;

an annular wall circumferentially continuous with an upper portion of the first slanting wall and extending generally upwardly therefrom;

an annular rim wall circumferentially continuous with an upper portion of the annular wall and extending generally outwardly and upwardly therefrom to form a generally upwardly and inwardly concave surface;

a top rim wall circumferentially continuous with an upper portion of the annular rim wall and extending generally outwardly therefrom; and a skirt wall circumferentially continuous with an outer portion of the top rim wall and extending generally downwardly therefrom; wherein the first slanting wall and the annular wall are interrupted by a plurality of projections, each of said plurality of projections having an upper surface portion forming a generally concave surface concavely continuous with a respective portion of the generally concave surface formed by the annular rim wall, said concave surface having an outer upwardly opening surface portion defined at least in part by the annular rim wall and an inner upwardly opening surface portion defined at least in part by an upwardly extending shoulder portion of each projection.

2. A closure as in claim 1 wherein:

at least a lower portion of the skirt wall curves inwardly; and further comprising a second slanting wall circumferentially continuous with the lower portion of the skirt wall and extending generally downwardly and outwardly therefrom.

3. A closure as in claim 2 wherein:

the concave surface formed by each projection and each respective concavely continuous portion of the annular rim wall is generally U-shaped, having at least a lower portion thereof which is generally circularly concave.

4. A closure as in claim 3 wherein:

a lower portion of the second slanting wall extends generally horizontally outwardly to form a generally horizontal ledge; and wherein the central diaphragm lies in a plane below said horizontal ledge.

5. A closure as in claim 4 wherein:

an upper extent of the first slanting wall and an upper extent of the second slanting wall are approximately coplanar thereby defining locking means for locking the closure on a container having a top outside roll or bead.

6. A closure as in claim 5 wherein:

each of said plurality of projections comprises an inner wall rising generally vertically from the central diaphragm generally concentrically with the annular wall, a first sidewall and a second sidewall rising generally vertically from the central diaphragm and joining the inner wall with the annular wall and the first slanting wall, the generally concavely curved upper surface portion concavely continuous with a respective portion of the annular rim wall, further being continuous with the respective upper portion of the inner wall, of the first sidewall, and of the second sidewall, and the concavely curved surface portion joining the inner wall to form a shoulder; and wherein the shoulder lies in a plane below at least an upper portion of the annular rim wall.

7. A closure as in claim 6 wherein:

at least an upper portion of the annular rim wall is generally cylindrical.

8. A closure as in claim 7 wherein:

at least an upper portion of the concave surface portion of each of said plurality of projections is generally cylindrical.

9. A closure as in claim 8 wherein:

the inner wall of each of said plurality of projections slants inwardly from its base to the shoulder at an angle in the range of 0 to 6 degrees from vertical.

10. A closure as in claim 9 wherein:

the inner wall of each of said plurality of projections slants inwardly from its base to the shoulder at an angle in the range of about 2 to 4 degrees from vertical.

11. A package comprising a container and a closure therefor, said container comprising:

a circumferentially continuous sidewall having an upper end portion curving outwardly and downwardly to form an outside rolled top rim and a lower end portion curving inwardly and upwardly to form an inside rolled bottom rim, said container further comprising a bottom member positioned within the space defined by the sidewall adjacent said lower end portion; and the closure comprising:

a central diaphragm;

a first slanting wall circumferentially continuous with the central diaphragm and extending generally outwardly and upwardly therefrom;

an annular wall circumferentially continuous with an upper portion of the first slanting wall and extending generally upwardly therefrom, said annular wall having a maximum outside diameter at least as great as the minimum inside diameter of the container sidewall before a closure is applied thereto;

an annular rim wall circumferentially continuous with an upper portion of the annular wall and extending generally outwardly and upwardly therefrom, said annular rim wall having a generally concave upper surface portion which at least generally conforms to at least an outer portion of a rolled bottom rim of an at least substantially identical container superimposed thereabove;

a top rim wall circumferentially continuous with an upper portion of the annular rim wall and extending generally outwardly therefrom; and a skirt wall circumferentially continuous with an outer portion of the top rim wall and extending generally downwardly therefrom; wherein the first slanting wall and the annular wall are interrupted by a plurality of projections, each of said projections having an upper surface portion generally concavely continuous with a respective portion of the generally concavely curved annular rim wall, said concave surface having an outer upwardly opening surface portion defined at least in part by the annular rim wall and an inner upwardly opening surface portion defined at least in part by an upwardly extending shoulder portion of each projection, and wherein the upper surface portion at least generally conforms to at least an inner portion of a rolled bottom rim of an at least substantially identical container superimposed thereabove.

12. A package as in claim 11 wherein the closure further comprises:

at least a lower portion of the skirt wall curves inwardly; and further comprising a second slanting wall circumferentially continuous with the lower portion of the skirt wall and extending generally downwardly and outwardly therefrom.

13. A package as in claim 12 wherein:

the concave surface formed by each projection and each respective concavely continuous portion of the annular rim wall is generally U-shaped, having at least a lower portion thereof which is generally circularly concave.

14. A package as in claim 13 wherein:

a lower portion of the second slanting wall extends generally horizontally outwardly to form a generally horizontal ledge; and wherein the central diaphragm lies in a plane below said horizontal ledge.

15. A package as in claim 14 wherein:

an upper extent of the first slanting wall and an upper extent of the second slanting wall are approximately coplanar thereby defining locking means for locking the closure on the outside rolled top rim of the container.

16. A package as in claim 15 wherein:

the length of the skirt wall is at least as great as the vertical diameter of the outside rolled top rim of the container.

17. A package as in claim 16 wherein:

the length of the skirt wall is in the range of 1 to about three times the vertical diameter of the outside rolled top rim of the container.

18. A package as in claim 17 wherein:

the length of the skirt wall is in the range of about $1\frac{1}{4}$ to about $2\frac{1}{2}$ times the vertical diameter of the rolled top rim of the container.

19. A package as in claim 18 wherein:

each of said plurality of projections comprises an inner wall rising generally vertically from the central diaphragm generally concentrically with the annular wall, a first sidewall and a second sidewall rising generally vertically from the central diaphragm and joining the inner wall with the annular wall and the first slanting wall, the generally concavely curved upper surface portion concavely continuous with a respective portion of the annular rim wall, further being continuous with the respective upper portions of the inner wall, of the first sidewall, and of the second sidewall, and the concavely curved surface portion joining the inner wall to form a shoulder; and wherein the shoulder lies in a plane below at least an upper portion of the annular rim wall.

20. A package as in claim 19 wherein:

at least an upper portion of the annular rim wall is generally cylindrical, the diameter of the upper portion being slightly greater than the corresponding outside diameter of a constrainer of substantially identical conformation superimposed thereabove.

21. A package as in claim 20 wherein:

at least an upper portion of the concave surface portion of each of said plurality of projections is generally cylindrical, the diameter of said upper portion being sightly less than the inside diameter of an inside bottom rolled rim of a substantially identical superimposed container.

22. A package as in claim 21 wherein:

the inner wall of each of said plurality of projections slants inward from its base to the shoulder at an angle in the range of 0 to 6 degrees from vertical.

23. A package as in claim 22 wherein:

the inner wall of each of said plurality of projections slants inwardly from its base to the shoulder at an angle in the range of about 2 to 4 degrees from vertical.

24. A closure as in claim 1 wherein:

the concave surface formed by each projection and each respective concavely continuous portion of the annular rim wall is generally U-shaped, having at least a lower portion thereof which is generally circularly concave.

25. A closure as in claim 24 wherein:

each of said plurality of projections comprises an inner wall rising generally vertically from the central diaphragm generally concentrically with the annular wall, a first sidewall and a second sidewall rising generally vertically from the central diaphragm and joining the inner wall with the annular wall and the first slanting wall, the generally concavely curved upper surface portion concavely continuous with a respective portion of the annular rim wall, further being continuous with the respective upper portion of the inner wall, of the first sidewall, and of the second sidewall, and the concavely curved surface portion joining the inner wall to form a shoulder; and wherein the shoulder lies in a plane below at least an upper portion of the annular rim wall.

26. A package as in claim 11 wherein:

the concave surface formed by each projection and each respective concavely continuous portion of the annular rim wall is generally U-shaped, having at least a lower portion thereof which is generally circularly concave.

27. A package as in claim 26 wherein:

each of said plurality of projections comprises an inner wall rising generally vertically from the central diaphragm generally concentrically with the annular wall, a first sidewall and a second sidewall rising generally vertically from the central diaphragm and joining the inner wall with the annular wall and the first slanting wall, the generally concavely curved upper surface portion concavely continuous with a respective portion of the annular rim wall, further being continuous with the respective upper portions of the inner wall, of the first sidewall, and of the second sidewall, and the concavely curved surface portion joining the inner wall to form a shoulder; and wherein the shoulder lies in a plane below at least an upper portion of the annular rim wall.

* * * * *